US007764902B2

(12) United States Patent
Silva

(10) Patent No.: US 7,764,902 B2
(45) Date of Patent: Jul. 27, 2010

(54) METHODS OF INCREASING PRINTER CARTRIDGE COMPATIBILITY

(75) Inventor: Gary Silva, Reseda, CA (US)

(73) Assignee: Future Graphics Imaging Corporation, San Fernando, CA (US)

( * ) Notice: Subject to any disclaimer, the term of this patent is extended or adjusted under 35 U.S.C. 154(b) by 526 days.

(21) Appl. No.: 11/880,214

(22) Filed: Jul. 19, 2007

(65) Prior Publication Data

US 2009/0003874 A1 Jan. 1, 2009

(51) Int. Cl.
*G03G 15/00* (2006.01)

(52) U.S. Cl. ..... 399/109

(58) Field of Classification Search ..... 399/109, 399/111, 113

See application file for complete search history.

(56) References Cited

U.S. PATENT DOCUMENTS

| | | | | |
|---|---|---|---|---|
| 5,261,326 | A * | 11/1993 | Michlin | 101/483 |
| 6,654,577 | B1 * | 11/2003 | Hooper | 399/109 |
| 6,801,734 | B1 * | 10/2004 | Jones et al. | 399/109 |
| 6,904,248 | B2 * | 6/2005 | Daniels | 399/109 |
| 7,054,577 | B2 * | 5/2006 | Rogers et al. | 399/109 |
| 7,068,963 | B2 * | 6/2006 | Moore et al. | 399/109 |
| 7,477,864 | B2 | 1/2009 | Daniels | |
| 2007/0140732 | A1 | 6/2007 | Jones et al. | |
| 2007/0217814 | A1 | 9/2007 | Causey et al. | |
| 2008/0008494 | A1 * | 1/2008 | Martin et al. | 399/109 |
| 2008/0008495 | A1 * | 1/2008 | Martin et al. | 399/109 |
| 2009/0257774 | A1 * | 10/2009 | Rummler et al. | 399/109 |

FOREIGN PATENT DOCUMENTS

DE 202008012287 U1 * 12/2008

OTHER PUBLICATIONS

Product instructions from www.fgimaging.com, posted Apr. 21, 2005, FG Universal Waste Hopper Kit for HP1150/1200/1300.
Product instructions from www.fgimaging.com posted Oct. 20, 2005, HP2500/1500 to HP2550 Conversion End Caps.
Product instructions from www.fgimaging.com posted Oct. 26, 2007, HPP2015 Universal Waste Hopper Conversion Kit.
Product instructions from www.fgimaging.com posted Oct. 10, 2005, HP4250 End Cap.

* cited by examiner

*Primary Examiner*—Robert Beatty

(57) ABSTRACT

A method of converting a first printer cartridge to a second printer cartridge, the second printer cartridge comprising a waste hopper, the second printer cartridge comprising a plurality of positioning pins on both sides of the waste hopper, the method comprising: determining the positions of the positioning pins of the second printer cartridge; providing positioning pins for the first printer cartridge; and attaching the positioning pins to the first printer cartridge at the previously determined positions.

20 Claims, 17 Drawing Sheets

METHODS OF INCREASING PRINTER CARTRIDGE COMPATIBILITY

FIELD OF INVENTION

The present invention relates to electrophotography, particularly methods and apparatus for manufacturing and remanufacturing toner cartridges.

BACKGROUND

Printer cartridges of fax machines, copiers, inkjet printers, and laser printers are often remanufactured. Printer cartridge re-manufacturers may first purchase or gather used printer cartridges that are often from original equipment manufacturers (OEMs) and often have empty toner (and thus are commonly known in the industry as "empties"). The re-manufacturers may then clean the used printer cartridges, replace any damaged parts, add toner, and replace worn parts.

Certain printers are specific as to the printer cartridge that may work with them. Remanufactured printer cartridges that are compatible with certain printers may be in demand more than other remanufactured printer cartridges. However, empties for these printer cartridges may be limited in supply. Methods and apparatus for increasing the supply of empties of certain printer cartridges are desired and are addressed by the present invention.

BRIEF DESCRIPTION OF THE PREFERRED EMBODIMENTS OF THE PRESENT INVENTION

A method of modifying a printer cartridge, the printer cartridge being configured to be used with a first printer, the printer cartridge comprising a first toner hopper, a waste hopper connected to the first toner hopper, an end cap connected to the toner hopper, and a guide key connected to the end cap, the printer cartridge further comprising a bushing configured to surround a drum axle, the method comprising: modifying the guide key; modifying the bushing; providing a second printer; and, using the printer cartridge with the second printer.

A method of modifying a printer cartridge, the printer cartridge being configured to be used with a first printer, the printer cartridge comprising a first toner hopper and a waste hopper connected to the toner hopper, the method comprising: providing a second toner hopper, the second toner hopper being distinct from the first toner hopper; replacing the first toner hopper with the second toner hopper; providing a second printer; and using the cartridge with the second printer.

A method of converting a first printer cartridge to a second printer cartridge, the second printer cartridge comprising a second printer cartridge waste hopper, the waste hopper comprising a plurality of sides, the second printer cartridge further comprising a plurality of positioning pins configured to be attached to the sides of the waste hopper, the first printer cartridge comprising a first printer cartridge waste hopper, the first printer cartridge waste hopper comprising the same plurality of sides as the second printer cartridge waste hopper, the method comprising: determining the positions of the positioning pins on the waste hopper sides of the second printer cartridge; providing positioning pins for the first printer cartridge; and attaching the positioning pins to the waste hopper sides of the first printer cartridge at the previously determined positions.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Also, it is to be understood that the phraseology and terminology employed herein are for the purpose of description and should not be regarded as limiting. The detailed description makes references to printer cartridges from Hewlett Packard Company of Palo Alto, Calif. It should be understood that the invention may be practiced with printer cartridges from various other manufacturers, which may or may not be original equipment manufacturers (OEMs). The references to printer cartridges from Hewlett Packard Company are for illustration only and should not be regarded as limiting.

The present invention includes various methods of converting a printer cartridge that is initially designed for use with a particular printer to a printer cartridge that may be used with a different printer or multiple printers. At least one embodiment of the present invention involves changing the toner hopper of the cartridge so that the cartridge may be used with a different printer. Another embodiment of the present invention involves modifying at least a portion of a guide key that is attached to an end cap of a cartridge and changing a drum axle bushing of the cartridge to convert the cartridge into one that may be used for multiple printers. Another embodiment of the present invention involves combining both previously described embodiments. Yet another embodiment involves modifying the positions and structures of the positioning pins located on the sides of waste hopper of a printer cartridge. To understand how the methods may be executed, the structures of the various exemplary printer cartridges will first be explained then the various steps of each of the various methods will be discussed.

Printer Cartridges for HP1160 Printers

Figure 1:
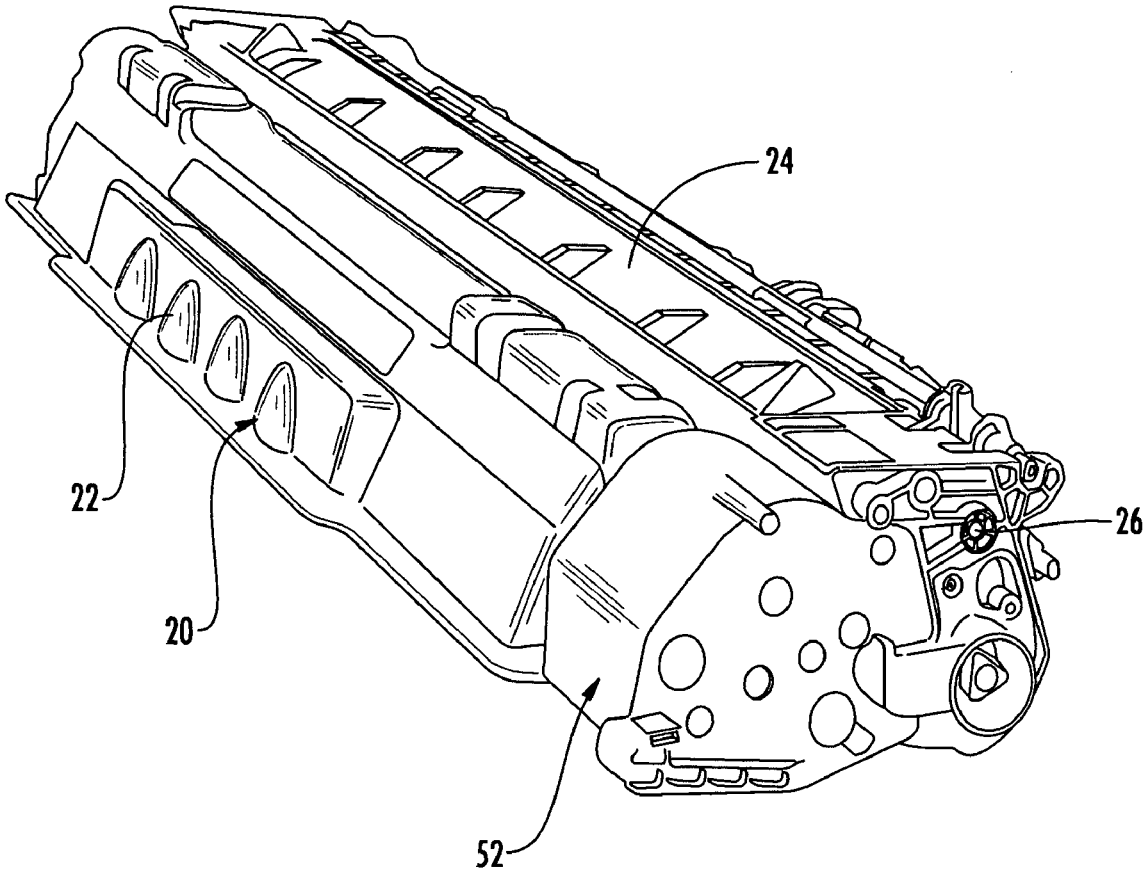
FIG. 1 (PRIOR ART)
FIG. 1 is substantially a perspective view of a first printer cartridge that is compatible with a first printer type.

As with typical printer cartridges, the printer cartridge 20 for an HP1160 printer includes a toner hopper 22, a waste hopper 24, and end caps 52 positioned on each side of the cartridge 20. The toner hopper 22 is where toner (not shown) is stored for use when printing. Excess toner (not shown) after printing is stored in the waste hopper 24. The toner hopper 22 and the waste hopper 24 are attached by cartridge pins 26 located on both sides of the cartridge (FIG. 1).

Printer Cartridges for HP1320 Printers

Figure 2:
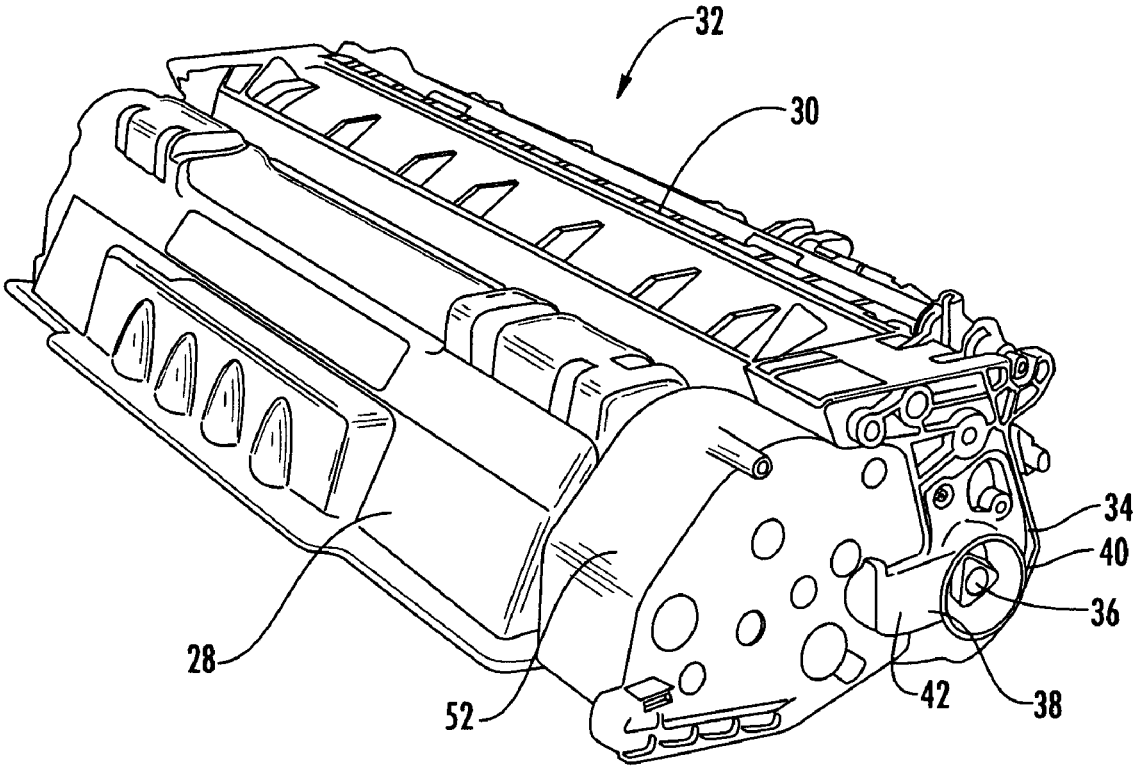
FIG. 2 (PRIOR ART)
FIG. 2 is substantially a perspective view of a second printer cartridge that is compatible with a second printer type.

The printer cartridge 32 for HP1320 printers also includes a toner hopper 28 and a waste hopper 30 (FIG. 2). The applicant has compared the printer cartridges for the HP1160 and HP1320 printers, and the applicant has observed that both cartridges have substantially the same waste hoppers 24,30 but different toner hoppers 22,28. The applicant has observed that the toner hopper 28 for the HP1320 printer 32 is bigger in size and toner capacity than the toner hopper 22 for the HP1160 printer cartridge 20. The applicant has further discovered that by changing the toner hopper 22 of the HP1160 printer cartridge 32 with a toner hopper of the same size and capacity as the toner hopper 28 of the HP1320 printer cartridge 20, the HP1160 printer cartridge 20 becomes usable with HP1320 printers.

First Embodiment of the Printer Cartridge Conversion Method

Figure 3:
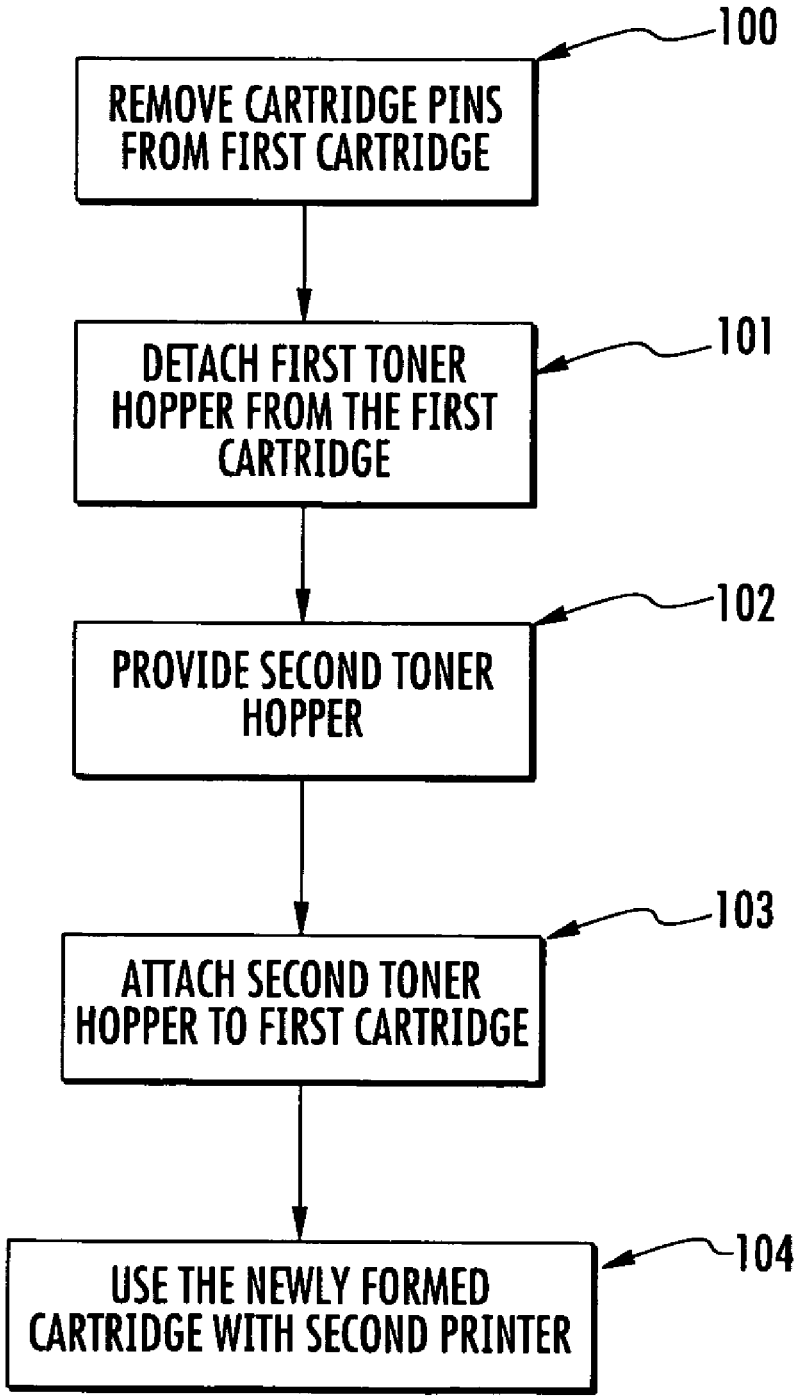
FIG. 3 is substantially a flowchart showing a first embodiment of the printer cartridge conversion method of the present invention.

Referring now to FIG. 3, to convert a printer cartridge that is initially designed to be used only for a single printer type (hereinafter a "first" printer type) to a cartridge that may be used with a different printer type (hereinafter a "second" printer type), the cartridge pins holding the toner hopper and waste hopper may be removed, such as pins 26 shown in FIG. 1 (step 100). The toner hopper may then be detached from the waste hopper (step 101).

Next, a larger toner hopper may be provided (step 102). In the example presented above, the larger toner hopper may come from a cartridge suitable for a second type of printer, such as the cartridge for the HP1320 printer. The larger toner hopper may not initially be suitable for the first printer type. The larger toner hopper may be from a used cartridge or may be a newly manufactured toner hopper. The larger toner hopper may then be installed to the cartridge from which the smaller toner hopper was previously removed (step 103). The newly formed cartridge may then be used for the second type of printers (step 104). In the example presented above, HP1160 cartridge is initially designed to be used only for an HP1160 printer. The HP1160 compatible cartridge was converted to the newly formed cartridge using the present invention, which may then be used for HP1320 printers. It can therefore be realized that certain embodiments of the present invention provide increased functionality and compatibility for certain printer cartridges.

Second Embodiment of the Printer Cartridge Conversion Method

The second embodiment of the printer cartridge conversion method is exemplified by the conversion of a cartridge for an HP1320 printer to a cartridge that may be used for an HP1320 printer, an HP2015 printer, or both. To understand the second embodiment of the present invention, the relevant components of the cartridges for HP1320 and HP2015 printers will now be explained.

HP1320 Printer Cartridges

Referring back to FIG. 2, cartridges 32 for the HP1320 printer include a waste bin 30, which is where a drum (not shown) is positioned. The drum (not shown) is attached to the sidewalls 34 of the waste bin via an axle 36. The axle 36 spans from the portion of the waste bin that is within the confines of the waste bin through the portion of the sidewall 34 that is opposite the confines of the waste bin (hereinafter "sidewall exterior"). The portion of the axle 36 that protrudes through the sidewall exterior is surrounded by a drum bushing 38, which includes a circular structure 40 surrounding the axle 36 and a bushing arm 42 attached to the circular structure 40.

Figure 4:
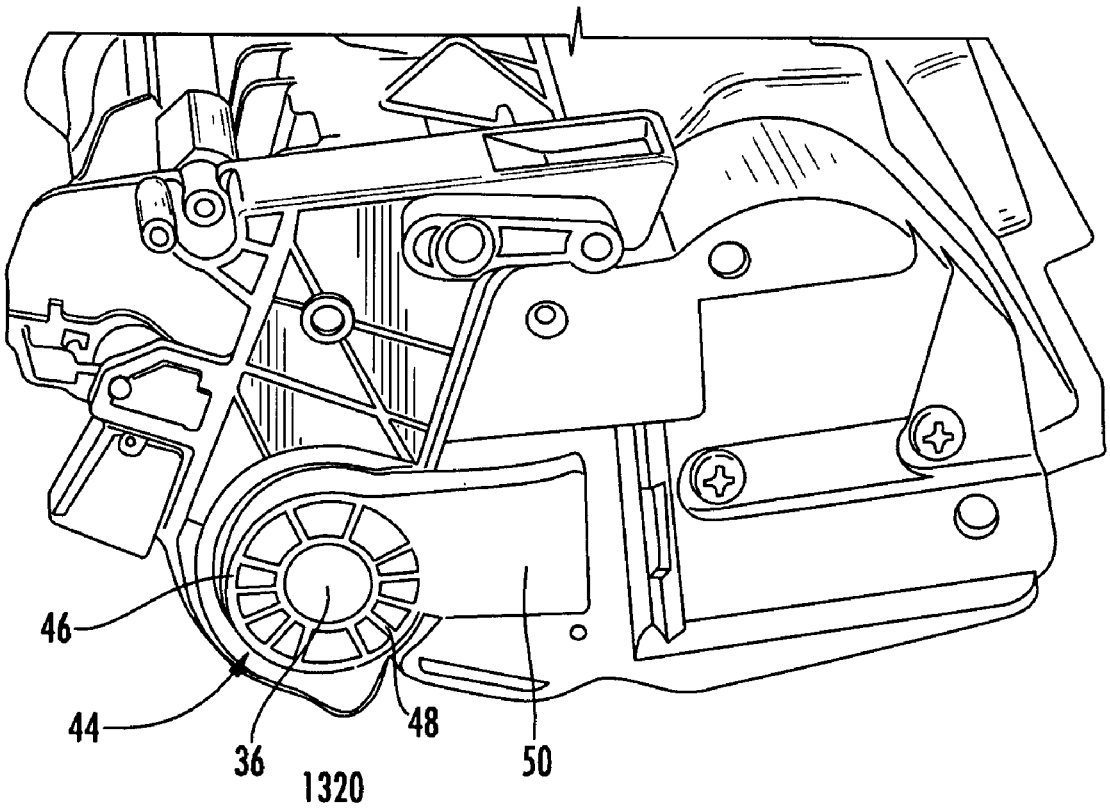
FIG. 4 (PRIOR ART)
FIG. 4 is substantially a front view of one side the first printer cartridge showing the drum bushing.
Figure 5:
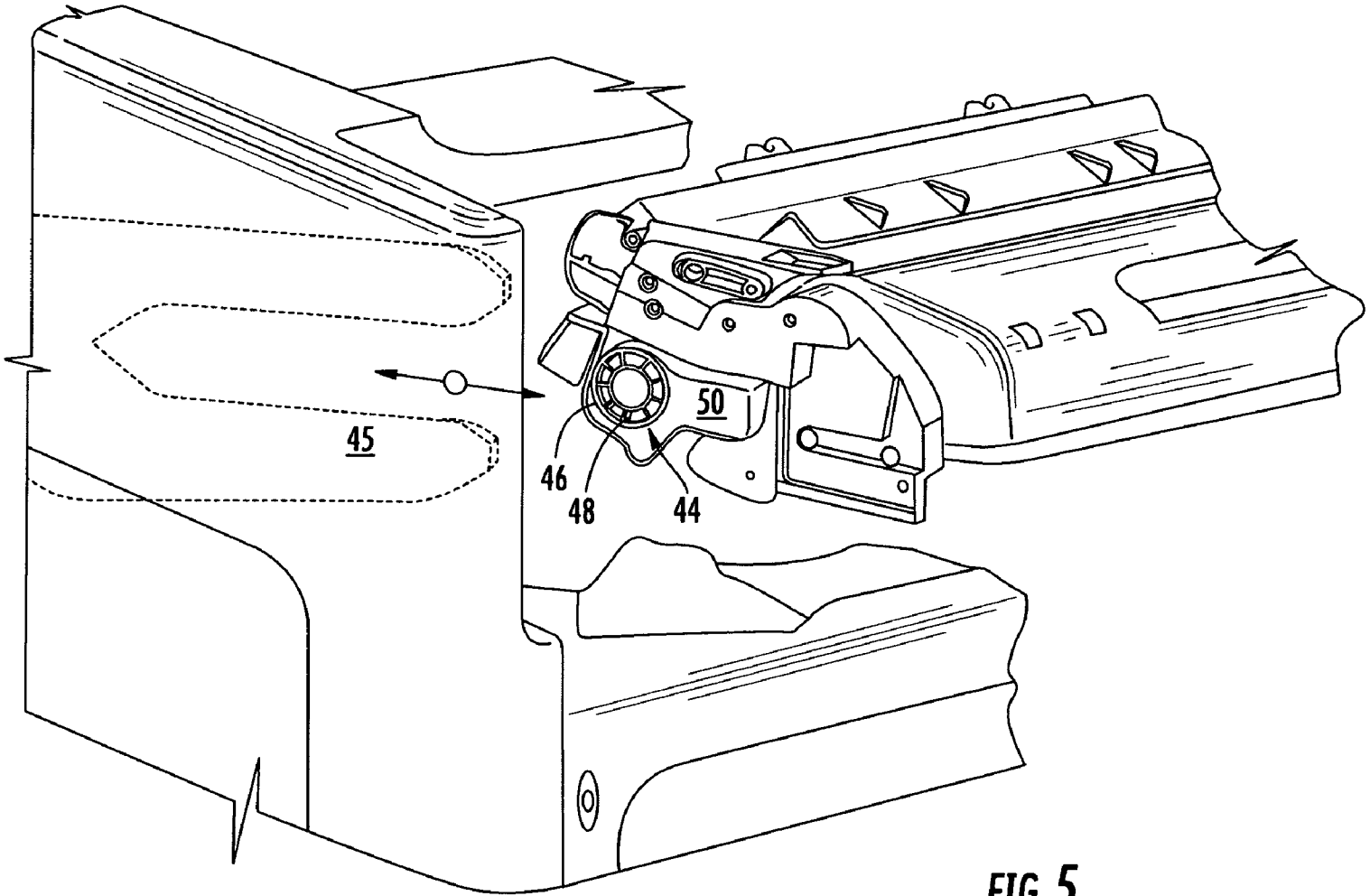
FIG. 5 (PRIOR ART)
FIG. 5 is substantially a perspective view of a portion of the printer housing showing the channel through which the drum bushing slides to place the printer cartridge at a predetermined position within the printer housing.

Referring now to FIG. 4, one side of the cartridge includes an engaging drum bushing 44. The engaging drum bushing 44 is configured to surround the drum axle 36 by its circular structure 46. The circular structure 46 includes a plurality of spokes 48 within it and which also surround the drum axle 36. The circular structure 46 is attached to an engaging bushing arm 50. The engaging drum bushing 44 is configured to fit through a drum bushing channel 45 formed on the sidewalls of a printer (FIG. 5), which serve as a mounting structure for holding the printer cartridge in a predetermined position within the printer housing.

Figure 6:
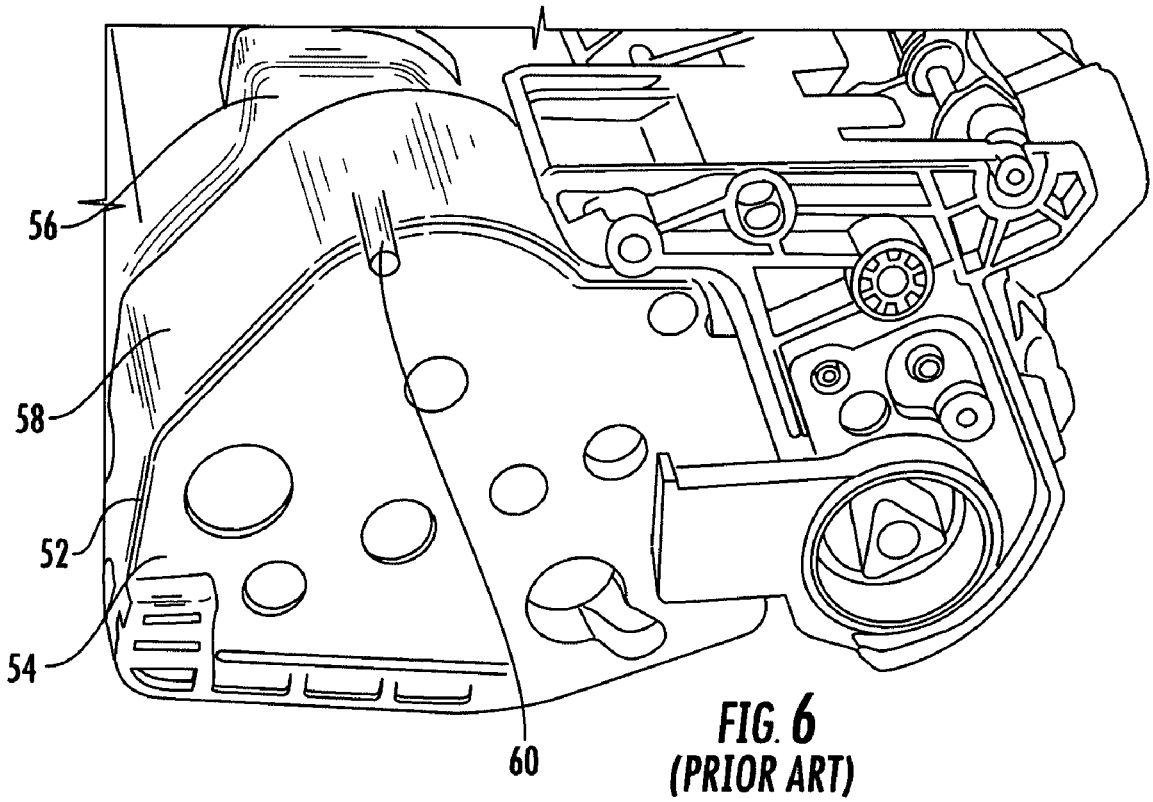
FIG. 6 (PRIOR ART)
FIG. 6 is substantially a front view of one side of the first printer cartridge showing the guide key that is attached to the end cap.

Referring now to FIG. 6, cartridges for HP1320 include end caps 52 positioned on each side. Each end cap includes a sidewall 54 that is substantially parallel to the sidewall of the toner hopper 56. Each end cap also includes a curved surface 58 that is positioned in between the end cap sidewall 54 and the toner hopper sidewall 56. One of the end caps includes an end cap guide key 60 attached to the curved surface 58.

Figure 7:
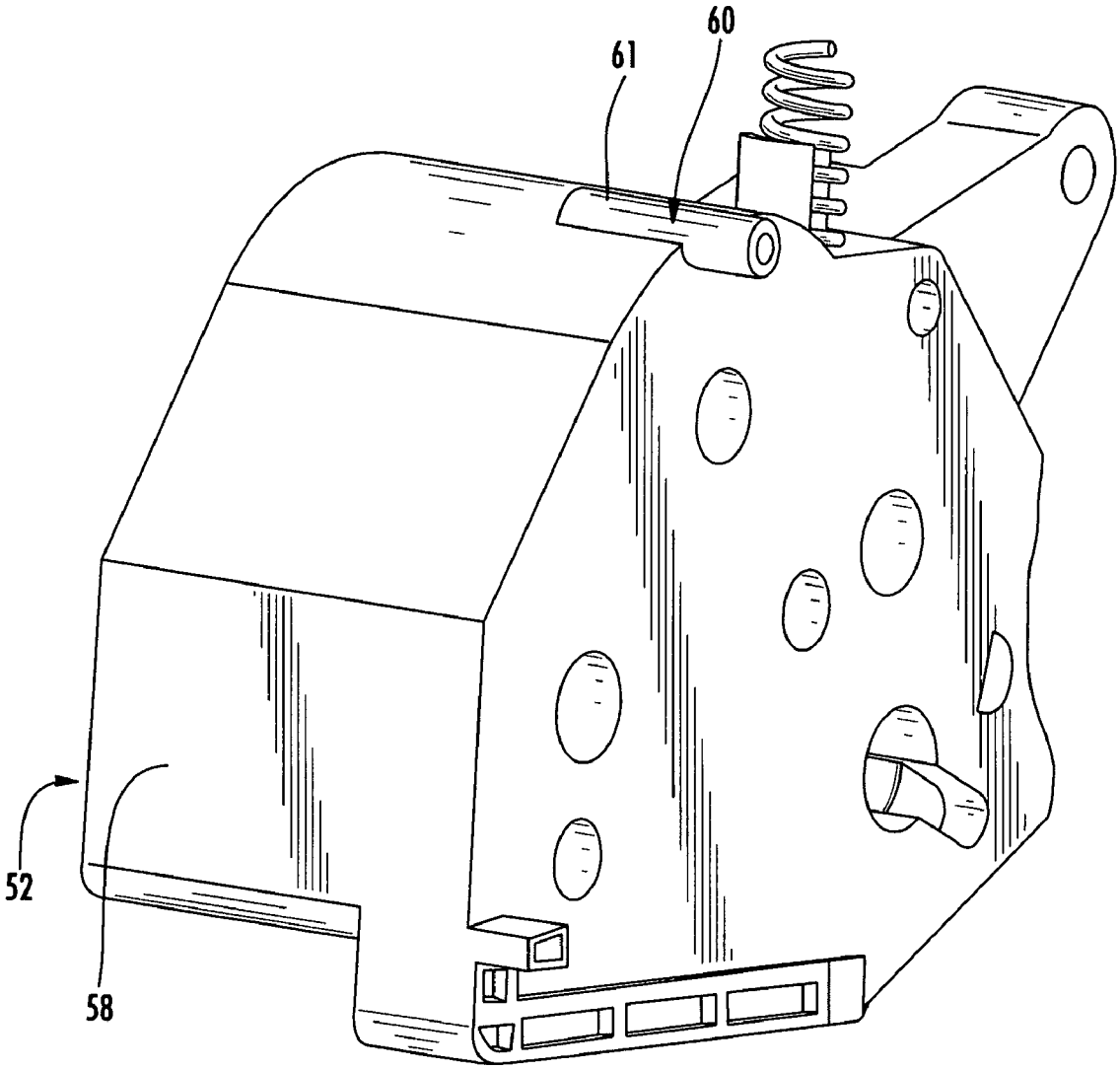
FIG. 7 (PRIOR ART)
FIG. 7 is substantially a perspective view of an end cap of the printer cartridge of FIG. 6.

Referring now to FIG. 7, the end cap guide key 60 includes a cylindrical body with a hollow interior positioned substantially horizontally relative to the top of the curved surface 58. The end cap guide key 60 is attached to the curved surface 58 in a manner wherein about half of the length of the end cap guide key 60 is partially buried within the end cap 52. About half of the cylindrical body is directly attached to the end cap 52 (hereinafter the "attached portion") while the remaining portion hangs from the end cap 52 (hereinafter the "hanging portion"). The attached portion 61 includes a height, and about half of the height of the attached portion 61 is embedded within the end cap 52. The remaining half of the height of the attached portion 61 protrudes from the surface of the end cap 52.

Printer Cartridges for HP2015 Printers

Figure 8:
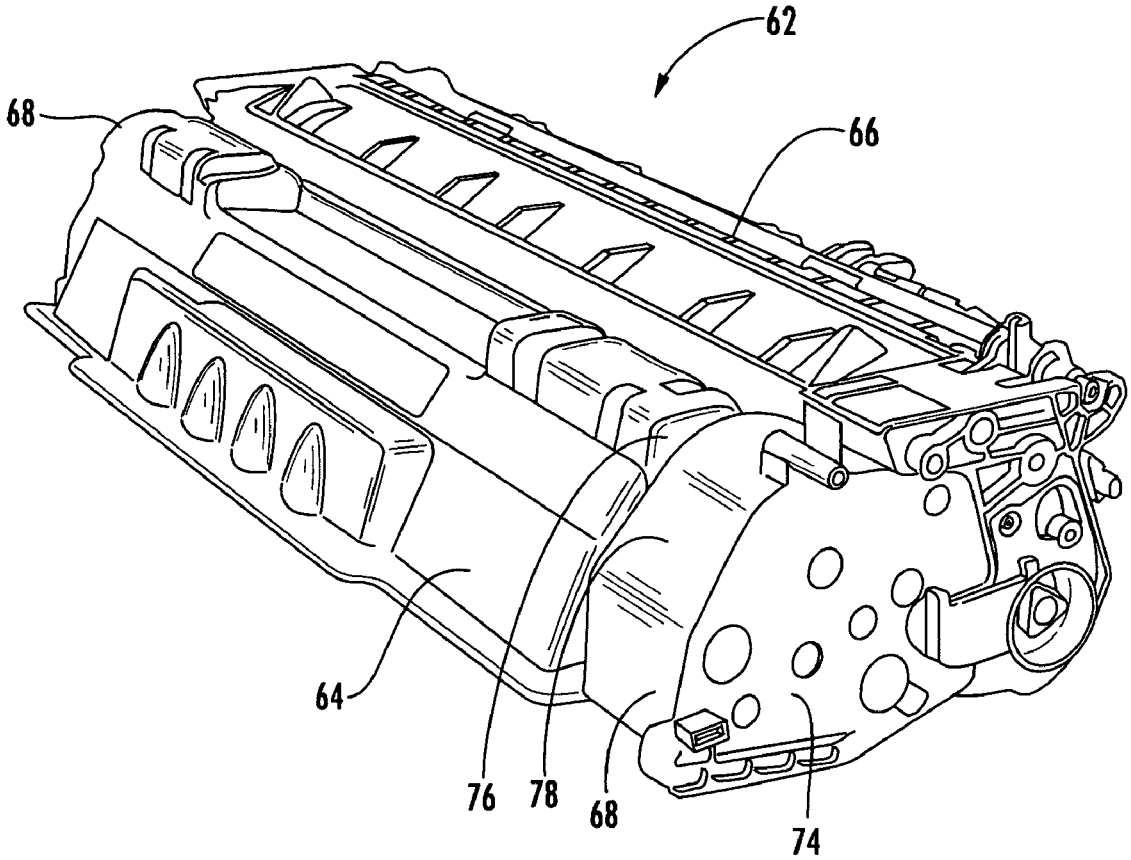
FIG. 8 (PRIOR ART)
FIG. 8 is substantially a perspective view of a third printer cartridge that is compatible with a third printer type.

Referring now to FIG. 8, printer cartridges 62 for the HP2015 printer include a toner hopper 64, waste hopper 66, and end caps 68 positioned on each of its sides. The end caps 68 are similar to the end caps 52 and include a sidewall 74, which is parallel to the toner hopper sidewall 76. The end caps 68 further include a curved surface 78 in between the end cap sidewall 74 and toner hopper sidewall 76.

Figure 9:
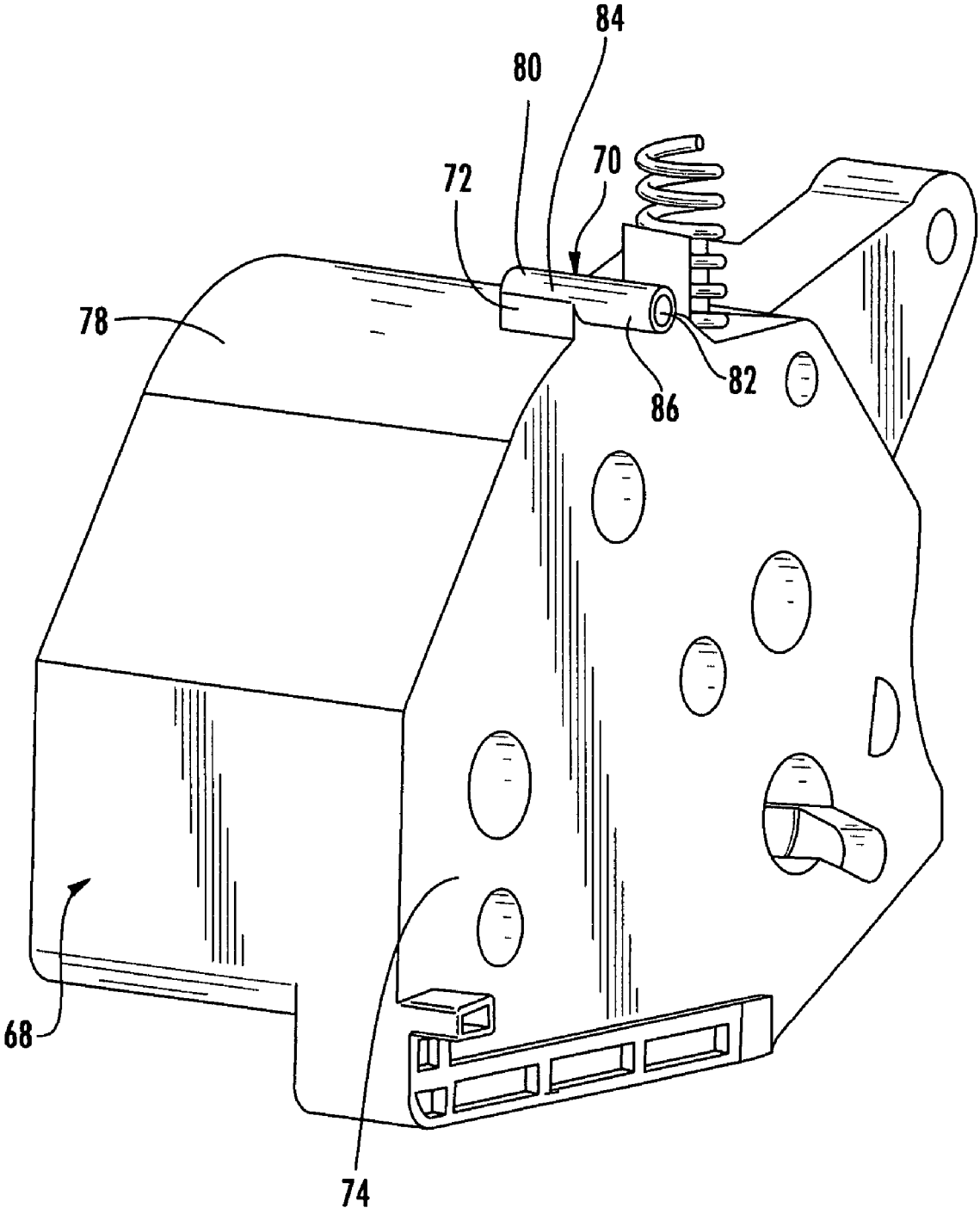
FIG. 9 (PRIOR ART)
FIG. 9 is substantially a perspective view of an end cap of the printer cartridge of FIG. 8.

Referring now to FIG. 9, one of the end caps 68 also includes a guide key 70 that is connected to the end cap curved surface 78 via a guide mount 72 (FIG. 8). The guide key 70 is raised from the end cap 68 by the guide mount 72, which is directly attached to the curved surface 78. The end cap guide key 70 includes a substantially cylindrical body 80 with a hollow interior 82 defined by the cylindrical body 80. A substantial first portion of the cylindrical body 84 is directly attached to the guide mount 72. The remaining second portion of the cylindrical body 86 of the end cap guide key 70 forms an overhang that extends from the sidewall of the end cap 74.

The applicant has discovered that the printer cartridge for the HP2015 (62) has significant similarities with the printer cartridge (32) for the HP1320. A few differences exist, and they include the designs of the guide keys attached to their respective end caps and the sizes of their drum axle bushings. The guide keys 80 for the HP2015 compatible printer cartridge 62 are mounted to the end caps 68 via a guide key mount 72, while the guide keys 60 for the HP1320 compatible printer cartridge 32 are mounted directly to the end caps 52 and are partially embedded therein.

As regards to the drum axle bushings, the printer cartridge (62) for the HP2015 include a drum axle bushing that has a smaller circular structure (not shown) than the circular structure 46 of the drum axle bushing 48 of the printer cartridge (32) for the HP1320. HP2015 compatible printer cartridge's corresponding arm that is connected to the circular structure of the drum axle bushing is also smaller than that of the HP1320 compatible printer cartridge.

Figure 10:
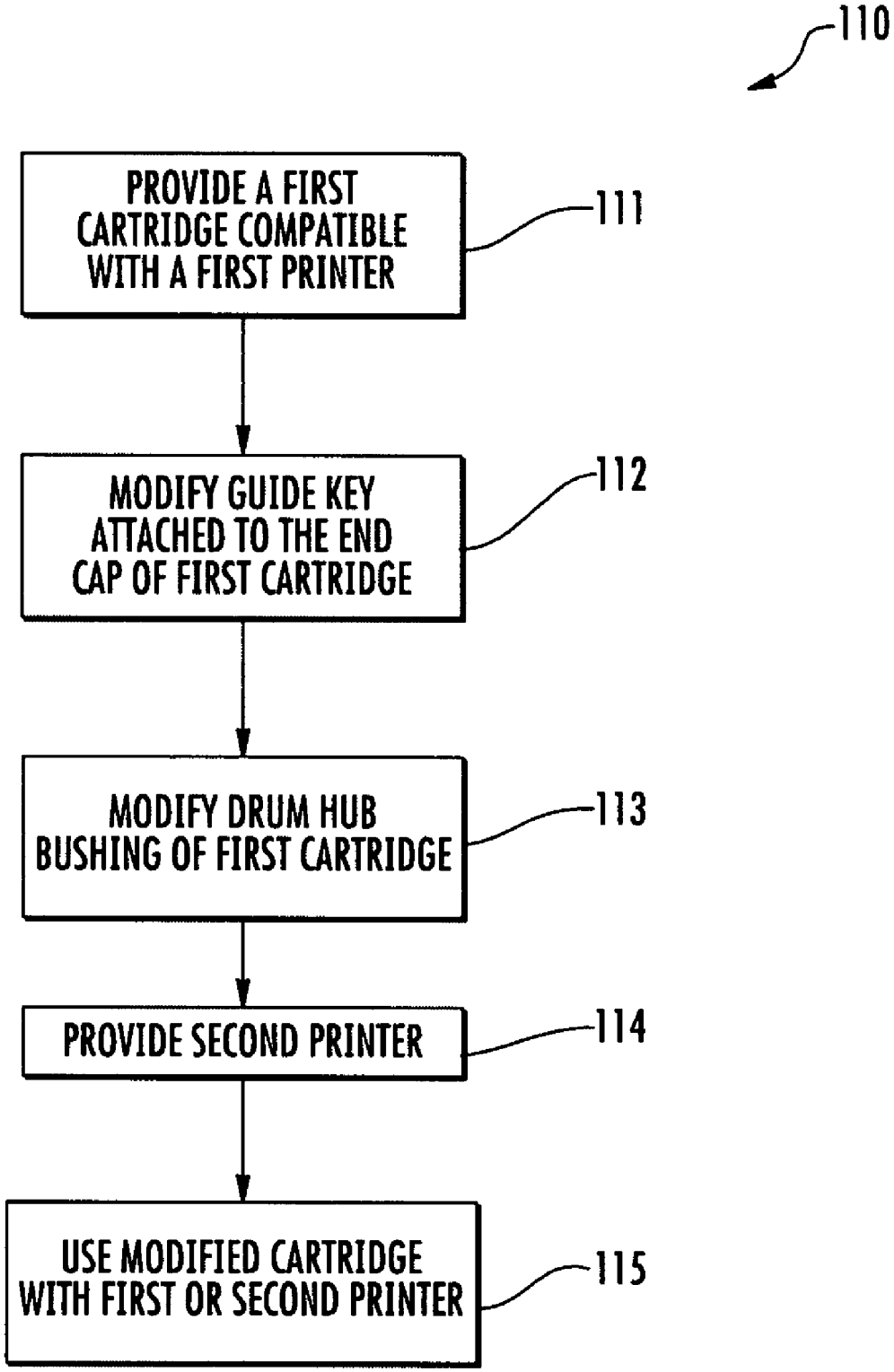
FIG. 10 is substantially a flowchart showing a second embodiment of the printer cartridge conversion method of the present invention.

Referring now to FIG. 10, the second embodiment (110) of the cartridge conversion method of the present invention includes providing a first cartridge that is compatible with a first printer type (step 111). In the example above, the first cartridge may be a cartridge that is compatible with HP1320 cartridge. The guide key that is attached on the end cap of the first cartridge may then be modified (step 112). For example, the guide key 80 may be cut to remove the overhang portion 86. A new end cap may also be provided without a guide key 80 or with a shortened guide key 80.

Next, the drum hub bushing of the first cartridge may be modified (step 113). For instance, the drum hub bushing of the first cartridge may be replaced with a smaller drum hub bushing. The replacement drum hub bushing may include a circular structure smaller than the circular structure 46 of the engaging drum hub bushing 44 of the HP1320 compatible cartridge. A second printer type may be provided (step 114), and the resulting modified cartridge may be used with the first or second printer types (step 115). In the example provided, the resulting modified cartridge which may initially be an HP1320 compatible printer cartridge may be used with the HP2015 printer. It is noted that with the present invention, the resulting modified cartridge may also be used with the first printer type. Thus, for example, the resulting modified cartridge may be used with the HP1320 printer despite having a modified guide key and bushing.

Third Embodiment of the Printer Cartridge Conversion Method

The third embodiment of the printer cartridge conversion method is exemplified by the conversion of a cartridge for an HP1160 printer to a cartridge that may be used for an HP1320 printer, and the subsequent conversion of the cartridge for the HP1320 printer to a cartridge that may be used for an HP1320 printer, an HP2015 printer, or both.

The cartridge for an HP1160 printer may be converted to an HP1320 compatible cartridge by executing the steps of the first embodiment of the printer cartridge conversion method discussed above. The HP1320 compatible cartridge may subsequently be converted to an HP2015 compatible cartridge and HP1320 compatible cartridge by executing the steps of the second embodiment of the printer cartridge conversion method discussed above.

Fourth Embodiment

The fourth embodiment of the printer cartridge conversion method may be illustrated by the conversion of a cartridge configured to be used with an HP2400 printer to a cartridge that may be used with an HP3005 printer.

HP2400 Compatible Printer Cartridge

Figure 11:
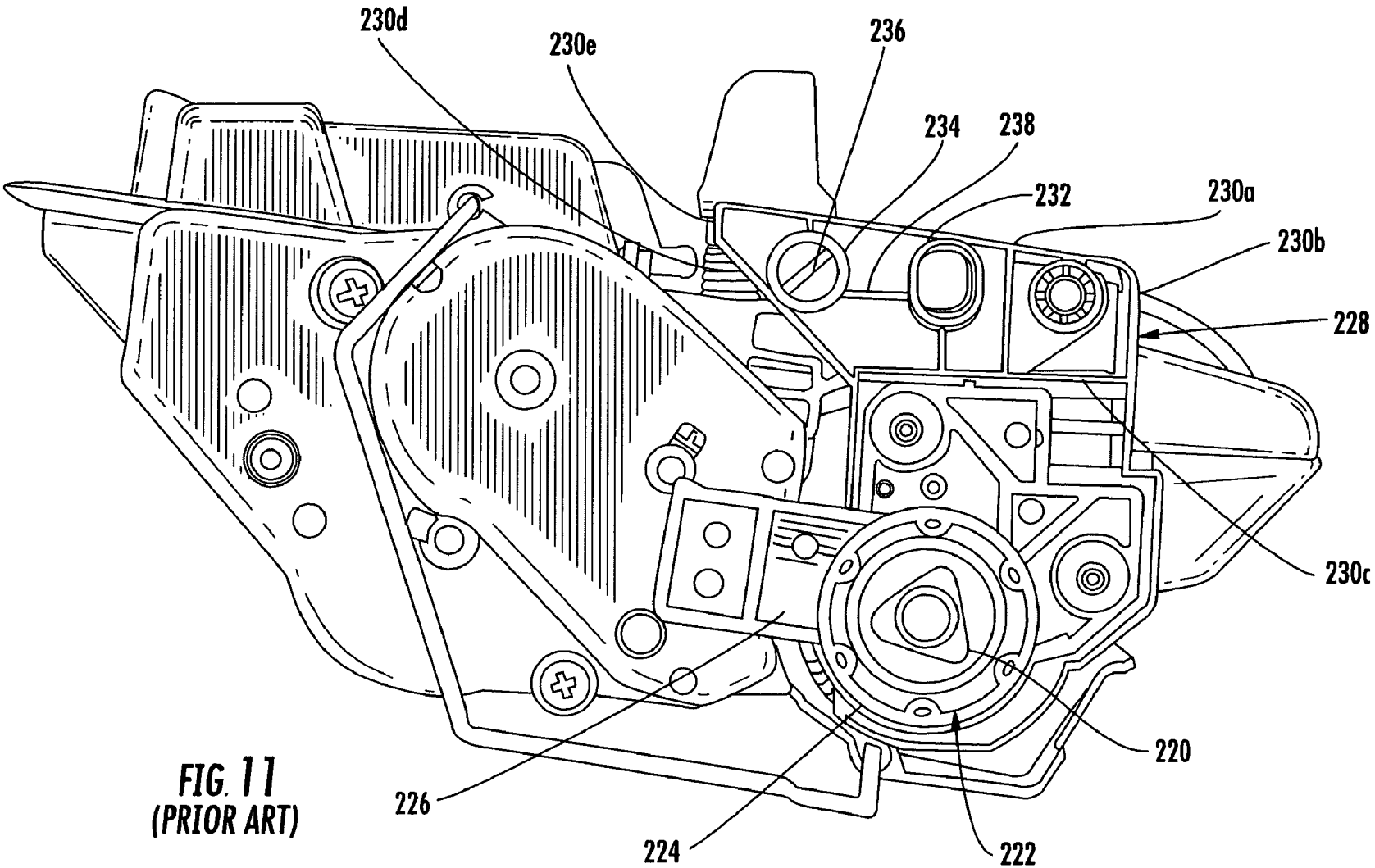
FIG. 11 (PRIOR ART)
FIG. 11 is substantially a front view of a side of a printer cartridge for which an embodiment of the conversion method of the present invention may be applied.
Figure 12:
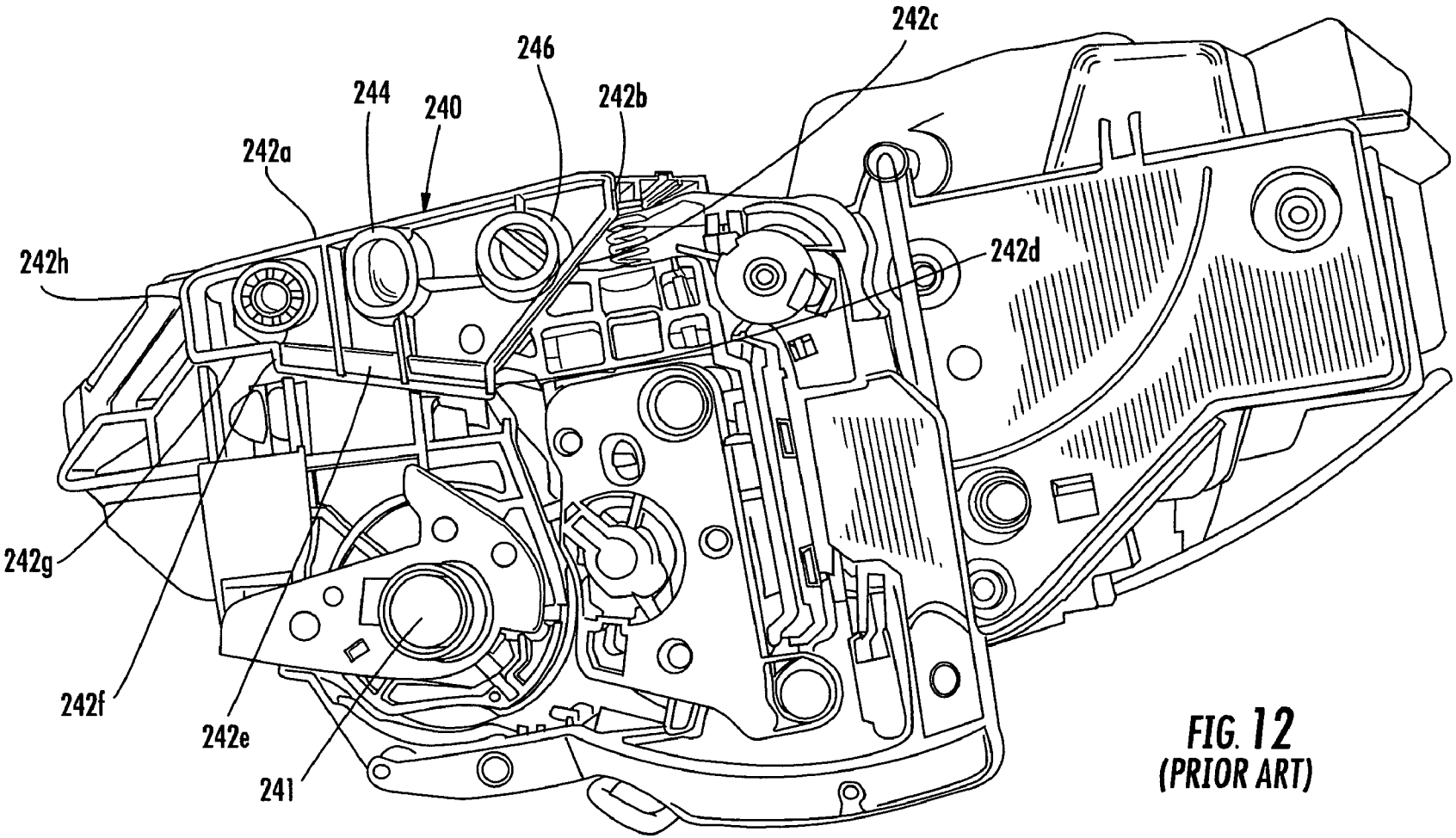
FIG. 12 (PRIOR ART)
FIG. 12 is substantially a front view of the printer cartridge side that is opposite the side shown in FIG. 11.

As with typical cartridges, an HP2400 compatible printer cartridge includes a toner hopper and a waste hopper. The waste hopper of an HP2400 compatible printer cartridge may include a drum gear side (FIG. 11) and a drum contact side (FIG. 12). Referring now to FIG. 11, the drum gear side is preferably the side of the waste hopper where the drum gear 220 is positioned. The drum gear 220 is typically the portion of the cartridge drum that engages to a printer portion (not shown) that rotates the drum. As shown in FIG. 11, the drum gear 220 may have a triangular structure and may be surrounded by a bushing 222. The bushing 222 may include a circular structure 224 that surrounds the drum gear 220 and a bushing arm 226 that is connected to the circular structure 224.

The drum gear side preferably further includes a drum gear side end plate 228. The drum gear side end plate 228 may include five sides 230*a-e*. A first positioning pin 232 and a second positioning pin 234 may be attached to the end plate 228 at predetermined positions within the perimeter defined by the sides 230*a-e* of the end plate 228. The first positioning pin 232 may be oval in shape and may include a hollow oval interior. The second positioning pin 234 may be circular in shape and may include a substantially straight first piece of material 236 positioned inside the circle of the second positioning pin 234. The first and second positioning pins 232 and 234 may be connected by a substantially straight second piece of material 238.

Referring now to FIG. 12, the drum contact side of the waste hopper is preferably the side wherein a drum axle and a drum electrical contact 241 are positioned. The drum axle (not shown) preferably holds the drum in proper position relative to the cartridge. The drum electrical contact 241 may allow the drum to obtain the necessary electrical communications from the printer and may be attached to the drum axle. The drum contact side may include a drum contact side end plate 240. End plate 240 may include eight sides 242*a-h*.

Within the perimeter defined by the eight sides 242*a-h* lies third and fourth positioning pins 244 and 246. Third and fourth positioning pins 244 and 246 are preferably the same in structure and placements on the end plate as the first and second positioning pins 232 and 234 (FIG. 11), respectively.

HP2400 and HP3005 Comparison

Figure 13:
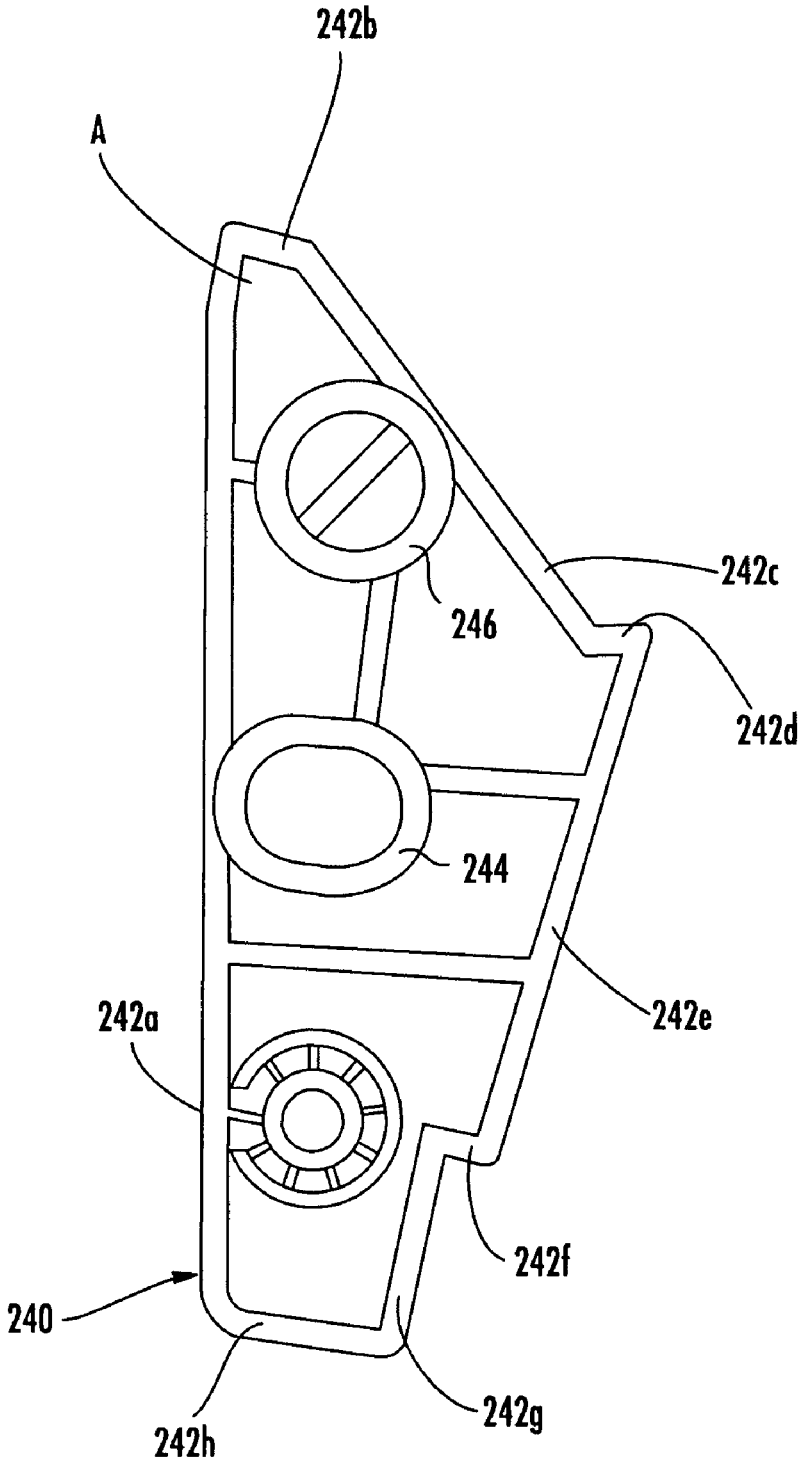
FIG. 13 (PRIOR ART)
FIG. 13 is substantially a front view of an end plate of the printer cartridge shown in FIGS. 11 and 12.
Figure 14:
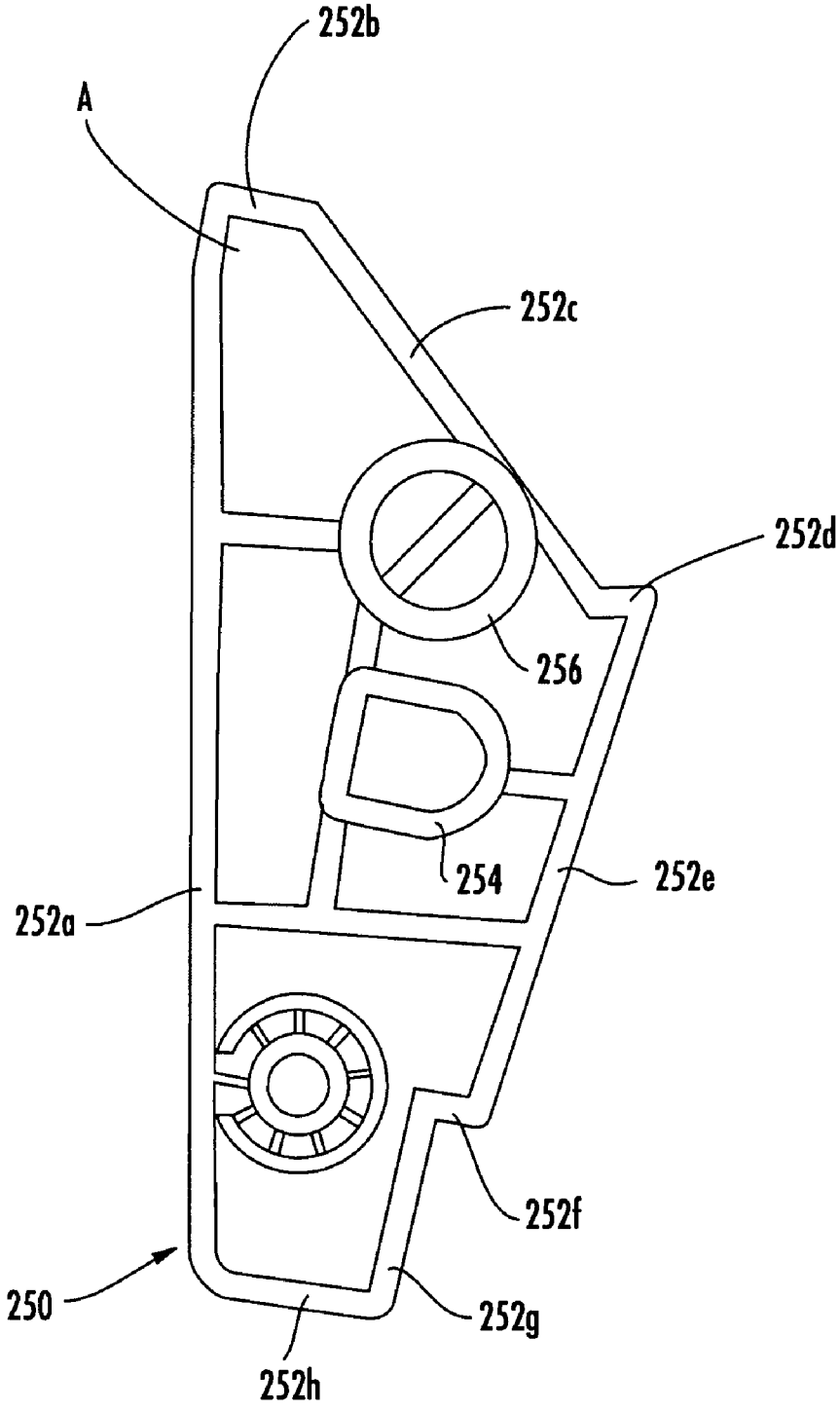
FIG. 14 (PRIOR ART)
FIG. 14 is substantially a front view of an end plate of another printer cartridge.

Referring now to FIGS. 13 and 14, the drum contact side end plates of HP2400 printer cartridge (240) and HP3005 printer cartridge (250) are similar in structure. End plates 240 and 250 each include eight sides. Each of the end plates 240 and 250 includes two positioning pins that are positioned within the perimeter of their respective eight sides. The end plate 250 for the HP3005 printer cartridge includes a positioning pin 256 that is similar in structure to the fourth positioning pin 246 of the HP2400 printer cartridge. However, the distance between the fourth positioning pin 246 and side 242*b* is less than the distance between the positioning pin 256 and side 252*b*. Stated differently, fourth positioning pin 246 of the HP2400 printer cartridge is positioned closer to the end plate corner A than positioning pin 256 of the HP3500 printer cartridge. Fourth positioning pin 246 is approximately 0.5 inch away from side 242*b* and 0.3 inch away from side 242*a*, while positioning pin 256 is approximately 0.69 inch away from side 252*b* and 0.49 inch away from side 252*a*. It is noted that the distances cited herein are measured from the center of the positioning pins and are merely approximations. The distances cited herein are intended to provide a clear understanding of the invention and should not be regarded as limiting.

With regard now to the positioning pin 254 of the end plate 250 for the HP3005 printer cartridge, positioning pin 254 may be a truncated oval structure, which comprises about three-fourths of the structure of third positioning pin 244 of the HP2004 printer cartridge. The third positioning pin 244 of the HP2004 printer cartridge includes a portion that contacts side 242*a*, which is absent in positioning pin 254. Third positioning pin 244 is approximately 1.130 inches away from side 242*b* and 0.195 inch away from side 242*a*, while positioning pin 254 is approximately 1.112 inch away from side 252*b* and 0.472 inch away from side 252*a*.

Figure 15:
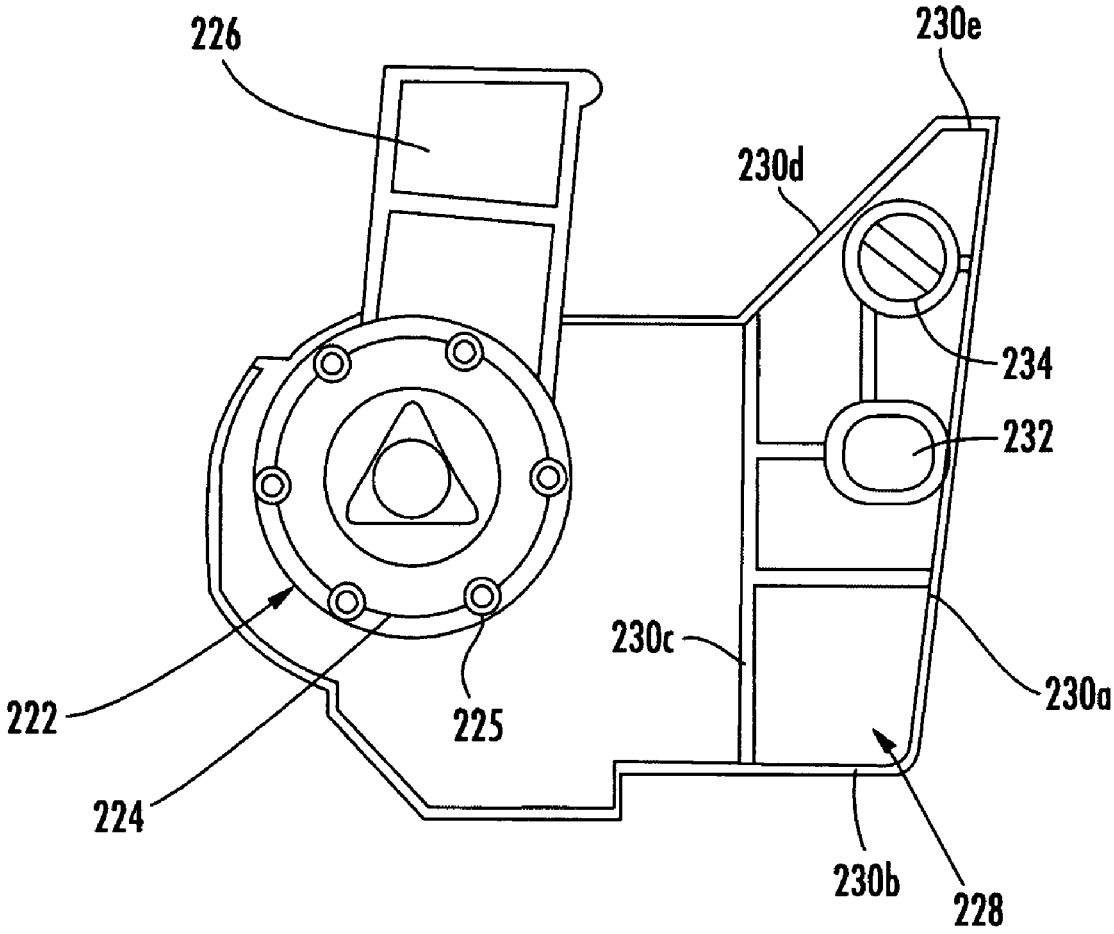
FIG. 15 (PRIOR ART)
FIG. 15 is substantially a front view of the waste hopper portion of the printer cartridge shown in FIG. 11.
Figure 16:
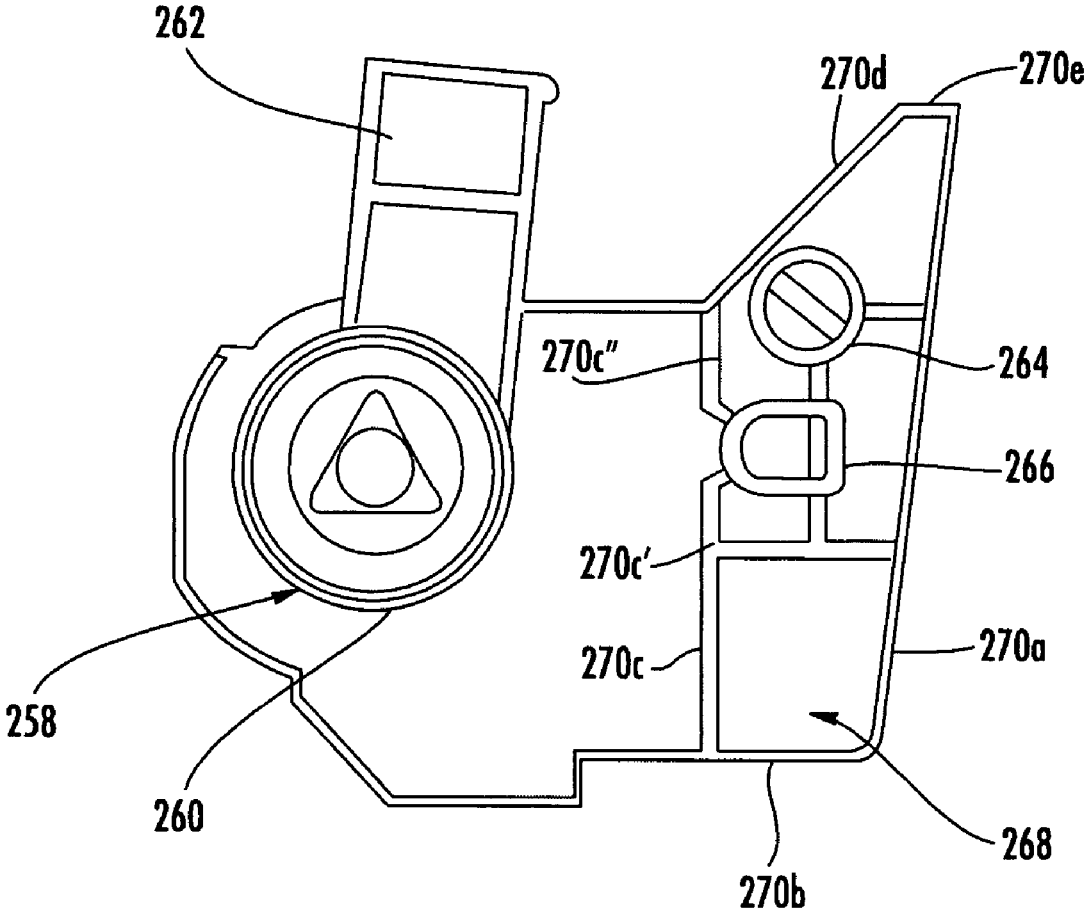
FIG. 16 (PRIOR ART)
FIG. 16 is substantially a front view of the waste hopper portion of another printer cartridge.

Referring now to FIGS. 15 and 16, the differences between the drum gear sides of an HP2004 printer cartridge and an HP3005 printer cartridge are shown wherein the circular structure 260 and the bushing arm 262 of the HP3005 printer cartridge are smaller than the circular structure 224 and bushing arm 226 of the HP2400 printer cartridge. Circular structure 260 includes an approximate diameter of 0.94 inch, while circular structure 224 includes an approximate diameter of 1.06 inches. Bushing arm 262 includes an approximate width of 0.60 inch, while bushing arm 226 includes an approximate width of 0.66 inch. Bushing 222 also includes a plurality of spokes 225, which is absent in bushing 258 of the HP3005 printer cartridge. Like the end plate 228 for the HP2400 printer cartridge, the end plate 268 for the HP3005 printer cartridge also has sides 270*a-e*. However, one of the sides of the end plate 268, 270*c*, is split into two parts 270*c*' and 270*c*". Side 270*c* is split at the area where positioning pin 266 is located.

The placements and structures of the positioning pins on the drum gear sides of an HP2004 printer cartridge and an HP3005 printer cartridge are also different, as shown in FIGS. 15 and 16. Positioning pin 266 includes a truncated oval structure unlike positioning pin 232 of the HP2400 printer cartridge, which has a full oval structure. Positioning pin 266 is also farther away from sides 270*a* and 270*e* compared to the relative position of positioning pin 232 to sides 230*a* and 230*e*. Specifically, positioning pin 266 is about 1.14 inches away from side 270*e*, while positioning pin 232 is 1.12 inches away from side 230*e*. Positioning pin 266 is about 0.64 inches away from side 270*a*, while positioning pin 232 is 0.40 inches away from side 230*a*. Positioning pin 264 of the HP3005 printer cartridge and positioning pin 234 of the HP2004 printer cartridge are the same in structure. However, positioning pin 264 is positioned about 0.67 inch away from side 270*e*, while positioning pin 234 is positioned about 0.47 inch away from 230*e*. Positioning pin 264 is positioned about 0.51 inch away from side 270*a*, while positioning pin 234 is positioned about 0.32 inch away from 230*e*.

In sum, the applicant has observed that the differences between an HP2400 printer cartridge and an HP3005 printer cartridge include: (1) the placements of the positioning pins on the drum contact side end plate, (2) the structures of the first and third positioning pins, (3) the structures and sizes of the drum bushing on the drum gear side, (4) the placements of the positioning pins on the drum gear side end plate, and (5) the structure of the drum gear side end plate.

Figure 17:
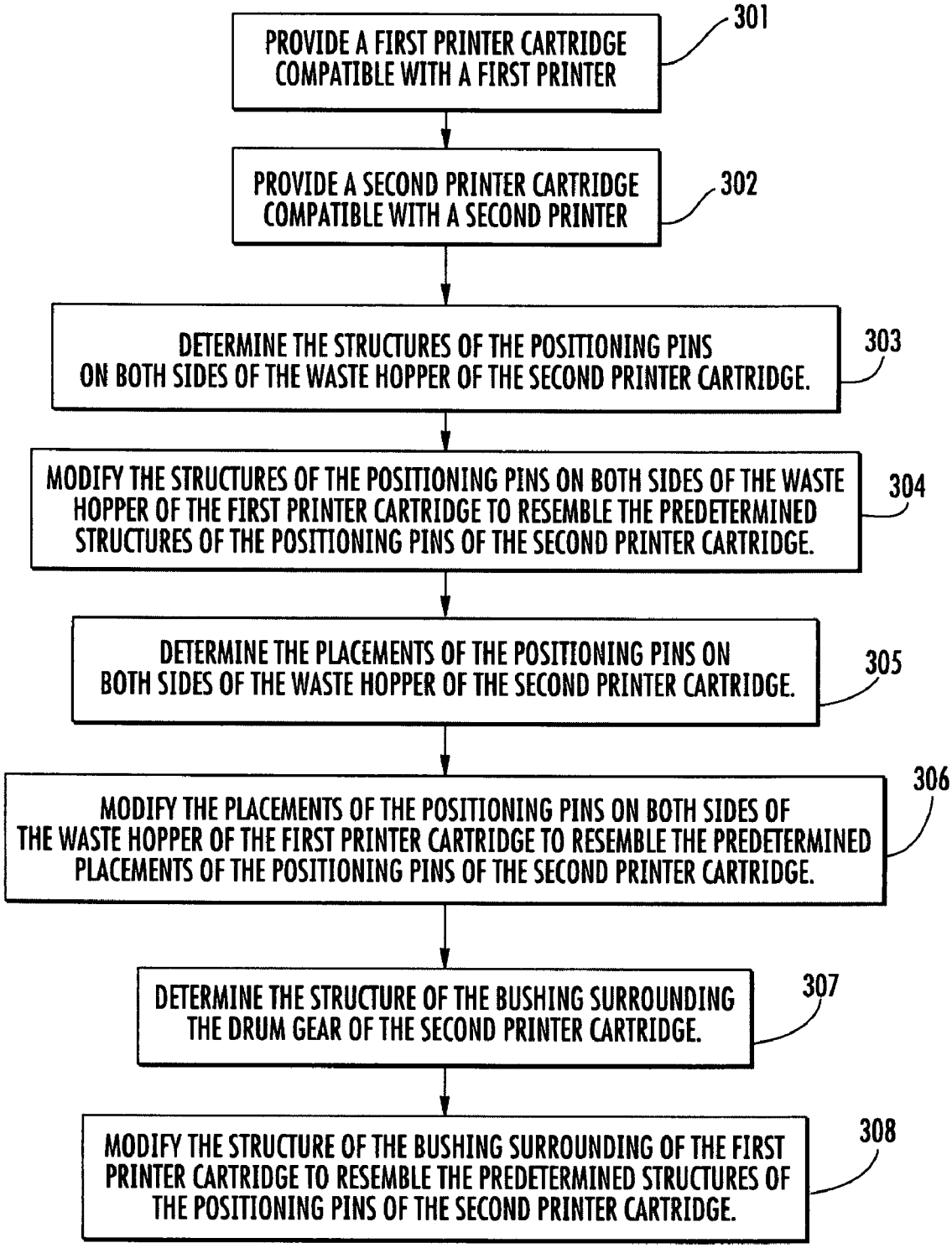
FIG. 17 is substantially a flowchart showing an embodiment of the printer cartridge conversion method of the present invention.

In light of the differences between the printer cartridges for HP2400 and HP3005, the present invention provides a method for modifying a printer cartridge so that it can be used for a printer that is different from the printer the printer cartridge was initially intended to be used with. Referring to FIG. 17, the method includes providing a first printer cartridge compatible with a first printer (step 301) and providing a second printer cartridge compatible with a second printer (step 302). The first printer cartridge may not initially work with the second printer, but with the present invention, the first printer cartridge may be modified to work with the second printer.

Next, the method includes determining the structures of the positioning pins on both sides of the waste hopper of the second printer cartridge (step 303). For instance, the structures of the positioning pins 256, 254, 266, and 266 may be determined to be circular, oval, or truncated oval structure. At step 304, the structures of the positioning pins on both sides of the waste hopper of the first printer cartridge may be modified to resemble the predetermined structures of the positioning pins of the second printer cartridge. It is noted that the positioning pins may come from the first printer cartridge, the second printer cartridge, or they may be entirely new positioning pins designed to resemble the positioning pins of the second printer cartridge.

Next, at step 305, the placements of the positioning pins on both sides of the waste hopper of the second printer cartridge may be determined. For instance, the distances between the center of each of the positioning pins and two sides of an end plate may be measured. At step 307, the placements of the positioning pins on both sides of the waste hopper of the first printer cartridge may be modified to resemble the predetermined placements of the positioning pins of the second printer cartridge. It is noted that end plates having positioning pins designed to resemble the predetermined structures and attached to the end plates at their predetermined positions may be provided. The end plates may include adhesives on the surface that is opposite to the end plate surface where the positioning pins are attached. To convert a cartridge to another cartridge, the end plate of the first printer cartridge may be replaced by the end plate with positioning pins designed to resemble the predetermined structures and attached at their predetermined positions. The end plate may be attached to the waste hopper using adhesives or fasteners known in the art.

Next, the structure of the bushing surrounding the drum gear of the second printer cartridge may then be determined (step 307). For instance, the dimensions of the bushing may be measured and certain characteristics of the bushing, such as the presence or the absence of spokes may be noted. Finally, at step 308, the structure of the bushing surrounding the drum gear of the first printer cartridge may be modified to resemble the predetermined structure of the bushing surrounding the drum gear of the second printer cartridge.

It can now be realized that certain embodiments of the present invention provides methods for increasing the availability of printer cartridges that may be in short supply. Accordingly, certain embodiments of the present invention may allow re-manufacturers of printer cartridges to save money from the cost of empties and increase their profitability. For example, an HP1160 printer cartridge may be converted to an HP1320 cartridge using the first embodiment of the present invention then to an HP2015 cartridge using the second embodiment of the present invention. Remanufacture of HP1320, HP2015, HP2400, and HP3005 cartridges is made possible by the present invention without having to rely on the presence of their respective empties.

Although the description above contains many specifications, these should not be construed as limiting the scope of the invention but as merely providing illustrations of some of the presently preferred embodiments of this invention. For example, the shapes and sizes of the modified end cap guide pins may be varied and still fall within the scope of the invention. The invention is capable of other embodiments and of being practiced and carried out in various ways. The invention is not limited in its application to the details of the construction and to the arrangement of the components set forth in the above description or as illustrated in the drawings.

What is claimed is:

1. A method for converting a first printer cartridge to a second printer cartridge, each of the first and second printer cartridges comprising a waste hopper, the waste hopper comprising a first side and a second side, the first side comprising a drum gear and a bushing positioned around the drum gear, the first side further comprising a first end plate, the first end plate comprising a plurality of positioning pins, the second side comprising a second end plate, the second end plate comprising a plurality of positioning pins, the method comprising:

a. removing the plurality of positioning pins of the first end plate and the second end plate of the first printer cartridge;

b. determining positions of the positioning pins on the first end plate and the second end plate of the second printer cartridge;

c. providing at least one replacement pin resembling at least one of the positioning pins of the second printer cartridge;

d. attaching a plurality of replacement pins to the first end plate and the second end plate of the first printer cartridge at the positions that were previously determined; and e. replacing the bushing of the first printer cartridge with a bushing resembling the bushing of the second printer cartridge.

2. The method of claim 1, wherein the replacement pin is different from the positioning pins of the first cartridge.

3. The method of claim 1, wherein the replacement pin is a truncated version of at least one of the positioning pins of the first printer cartridge that was removed.

4. The method of claim 1, wherein the step of removing the plurality of positioning pins of the first end plate and the second end plate of the first printer cartridge comprises removing the first end plate and the second end plate of the first printer cartridge.

5. The method of claim 1, wherein the step of replacing the bushing of the first printer cartridge further comprises removing the second printer cartridge bushing and using the second printer cartridge bushing.

6. The method of claim 1, wherein the step of replacing the bushing of the first printer cartridge further comprises determining the dimensions of the bushing of the second printer cartridge and creating a replacement bushing based on the dimensions.

7. A printer cartridge modified to work with a second printer, the printer cartridge originally configured to work with a first printer, the printer cartridge comprising:

a. a first waste hopper side, the first waste hopper side comprising:

i. a drum gear and a drum gear bushing positioned around the drum gear, the drum gear bushing comprising similar dimensions of a drum gear bushing of a second printer cartridge, the second printer cartridge being configured to work with a second printer and not with the first printer;

ii. an end plate comprising a plurality of sides, and iii. a plurality of positioning pins positioned within the sides of the end plate, the positions of the positioning pins within the sides of the end plate being predetermined from the positions of the positioning pins of a first waste hopper side of the second printer cartridge; and b. a second waste hopper side, the second waste hopper side comprising:

i. a drum axle and a drum electrical contact connected to the drum axle;

ii. an end plate comprising a plurality of sides; and iii. a plurality of positioning pins positioned within the sides of the end plate, the positions of the positioning pins within the sides of the end plate being predetermined from the positioning pins of a second waste hopper side of the second printer cartridge.

8. The printer cartridge of claim 7, wherein at least one of the positioning pins of the first waste hopper side of the first printer cartridge comprises the dimensions of a positioning pin of the first waste hopper side of the second printer cartridge.

9. The printer cartridge of claim 7, wherein at least one of the positioning pins of the second waste hopper side of the first printer cartridge comprises the dimensions of a positioning pin of the second waste hopper side of the second printer cartridge.

10. The printer cartridge of claim 7, wherein the drum gear bushing originated from the second printer cartridge.

11. The printer cartridge of claim 7, wherein the end plate of the first waste hopper side originated from the second printer cartridge.

12. The printer cartridge of claim 11, wherein the positioning pins of the first waste hopper side are attached to the end plate.

13. The printer cartridge of claim 12, further comprising an adhesive attached to the end plate at a location opposite where the positioning pins are attached.

14. The printer cartridge of claim 7, wherein the end plate of the second waste hopper side originated from the second printer cartridge.

15. The printer cartridge of claim 14, wherein the positioning pins of the second waste hopper side are attached to the end plate.

16. The printer cartridge of claim 15, further comprising an adhesive attached to the end plate at a location opposite where the positioning pins are attached.

17. A method of converting a first printer cartridge to a second printer cartridge, the second printer cartridge comprising a waste hopper, the second printer cartridge comprising a plurality of positioning pins on both sides of the waste hopper, the method comprising:

a. determining the positions of the positioning pins of the second printer cartridge;

b. providing positioning pins for the first printer cartridge; and c. attaching the positioning pins to the first printer cartridge based on the previously determined positions.

18. The method of claim 17, further comprising:

a. attaching the positioning pins to at least one end plate; and b. attaching the at least one end plate to at least one side of the waste hopper of the first printer cartridge.

19. The method of claim 17, further comprising:

a. determining the structures of the positioning pins of the second printer cartridge; and b. providing positioning pins for the first printer cartridge that resemble the predetermined structures of the positioning pins of the second printer cartridge.

20. The method of claim 17, wherein each of the first and the second printer cartridges comprises a drum gear bushing attached on one of its waste hopper sides, the method further comprising modifying the drum gear bushing of the first printer cartridge to resemble the drum gear bushing of the second printer cartridge.

* * * * *